US007237410B2

(12) United States Patent
Millist

(10) Patent No.: US 7,237,410 B2
(45) Date of Patent: Jul. 3, 2007

(54) SURFBOARD LOCK

(76) Inventor: Michael Millist, 72 Atchison Street, Crows Nest, New South Wales (AU) 2065

( * ) Notice: Subject to any disclaimer, the term of this patent is extended or adjusted under 35 U.S.C. 154(b) by 22 days.

(21) Appl. No.: 10/495,178

(22) PCT Filed: Oct. 23, 2002

(86) PCT No.: PCT/AU02/01435

§ 371 (c)(1),
(2), (4) Date: May 11, 2004

(87) PCT Pub. No.: WO03/042476

PCT Pub. Date: May 22, 2003

(65) Prior Publication Data

US 2005/0020154 A1 Jan. 27, 2005

(30) Foreign Application Priority Data

Nov. 15, 2001 (AU) ..... PR8899

(51) Int. Cl.
*E05B 69/00* (2006.01)

(52) U.S. Cl. ..... 70/58; 70/14

(58) Field of Classification Search ..... 70/58, 70/14, 18

See application file for complete search history.

(56) References Cited

U.S. PATENT DOCUMENTS 3,990,182 A * 11/1976 Linder ..... 49/34
4,680,949 A * 7/1987 Stewart ..... 70/14
5,400,622 A * 3/1995 Harmon ..... 70/14
5,787,739 A * 8/1998 Derman ..... 70/58
5,907,962 A * 6/1999 Smithson et al. ..... 70/58
5,934,963 A 8/1999 Frizzell
6,105,922 A * 8/2000 Derman ..... 248/551
6,112,561 A * 9/2000 Carl ..... 70/58
6,691,537 B2 * 2/2004 Tan ..... 70/58

FOREIGN PATENT DOCUMENTS

GB 2 357 314 A 6/2001
WO WO 87/04399 7/1987
WO WO 9607002 A1 3/1996

* cited by examiner

*Primary Examiner*—Suzanne Dino Barrett
(74) *Attorney, Agent, or Firm*—Merchant & Gould P.C.

(57) ABSTRACT

A surfboard lock is described being of unitary construction and including a lock body including two engagement members; the engagement members are movable from a retracted position to an extended position and may be locked in the extended position; in the retracted position the engagement members may be at least partially introduced into the finbox opening of a surfboard; in the extended position the engagement members may engage with the internal walls of the finbox opening to resist removal of the lock therefrom; and attachment means affixed to the lock body for attaching the lock to a sturdy object.

8 Claims, 5 Drawing Sheets

SURFBOARD LOCK

TECHNICAL FIELD

This invention relates to a surfboard lock.

BACKGROUND TO THE INVENTION

Theft of surfboards is regrettably common. Thus, when a surfboard is left unattended in a public place, it would be desirable to use an anti-theft device such as a lock. However, surfboards are relatively large smooth items and are not readily secured by generic locking devices such as chains or padlocks. A specialised lock is required which will affix both to a surfboard and a sturdy object, such as a vehicle roof-rack, to prevent unauthorised removal of the surfboard.

Most Malibu surfboards have finboxes. These are produced in various standard sizes and are typically of elongate rectangular box like construction with a slot opening to the underside of the surfboard. The longer side walls of the finbox include longitudinally directed internal recesses designed to retain a surfboard fin. This provides an anchor to which one may affix a lock, albeit a rather inaccessible one.

To date, surfboard locks which affix to the finbox have been complex arrangements of separate components which must be carefully inserted and held before being retained in place by a padlock or other member. It is often difficult to hold several components together whilst engaging a padlock. Further, the separate components are prone to loss. This is particularly the case where the lock is being used on a beach where parts may fall and be lost in sand. There is a need for an arrangement which would ameliorate the above problem.

SUMMARY OF THE INVENTION

In a first aspect the present invention provides a surfboard lock being of unitary construction and including a lock body including two engagement members; the engagement members are movable from a retracted position to an extended position and may be locked in the extended position; in the retracted position the engagement members may be at least partially introduced into the finbox opening of a surfboard; in the extended position the engagement members may engage with the internal walls of the finbox opening to resist removal of the lock therefrom; the surfboard lock further including attachment means affixed to the lock body for attaching the lock to a sturdy object.

For the purposes of this specification a lock of unitary structure is one which, in use, has no separate components or parts. That is, it remains as one part during the operation of locking or unlocking. However, such a lock may be constructed from individual components.

Being of unitary construction, the lock is simple to operate. Further, there are no individual components of the lock to be lost or mislaid.

Preferably, the engagement members are movable between the extended and retracted positions by rotation about a hinge axis. This provides a simple and reliable mechanism for operating the lock.

Preferably, the two engagement members are formed integrally with two cover members. This reduces the overall number of components required to construct the lock.

Preferably, the cover members are pivoted to form the hinge axis.

Preferably, the engagement members may be locked in the extended position by inserting a locking pin into the lock.

Preferably, the engagement members may be locked in the extended position by inserting the locking pin through a hole in a cover member, the locking pin further abuts a locking piece affixed to the other cover member to resist relative movement between the cover members.

Preferably, the engagement members include oppositely and outwardly directed lugs. These engage with the longitudinal recesses found in the internal walls of finboxes.

Preferably, the attachment means includes an attachment member having a first end permanently affixed to the lock and a second end engageable to affix the lock to a sturdy object. The attachment member may by engaged to a vehicle roof rack, a telegraph pole or other sturdy object which is not easily moved.

Preferably, the second end of the attachment member is engageable with the lock body. The second end of the attachment member may be passed around a sturdy object and engaged with the lock body. This obviates the need for a separate padlock or the like for engaging the second end to a sturdy object.

Preferably, the attachment member is flexible. This advantageously allows the attachment member to be passed sturdy objects of varying shapes and sizes.

Preferably, the locking pin is attached to the second end of the engagement member. Thus, engagement of the second end of the attachment member with the lock body also locks the engagement members in the extended position. In this way, the second end of the attachment member performs two functions and reduces the number of parts required to construct the lock.

BRIEF DESCRIPTION OF THE DRAWINGS

It will hereinafter be convenient to describe an embodiment of the invention with reference to the accompanying drawings. It is to be understood that the particularity of these drawings and the related description does not supersede the preceding broad description of the invention.

DETAILED DESCRIPTION OF THE PREFERRED EMBODIMENT

Figure 1:
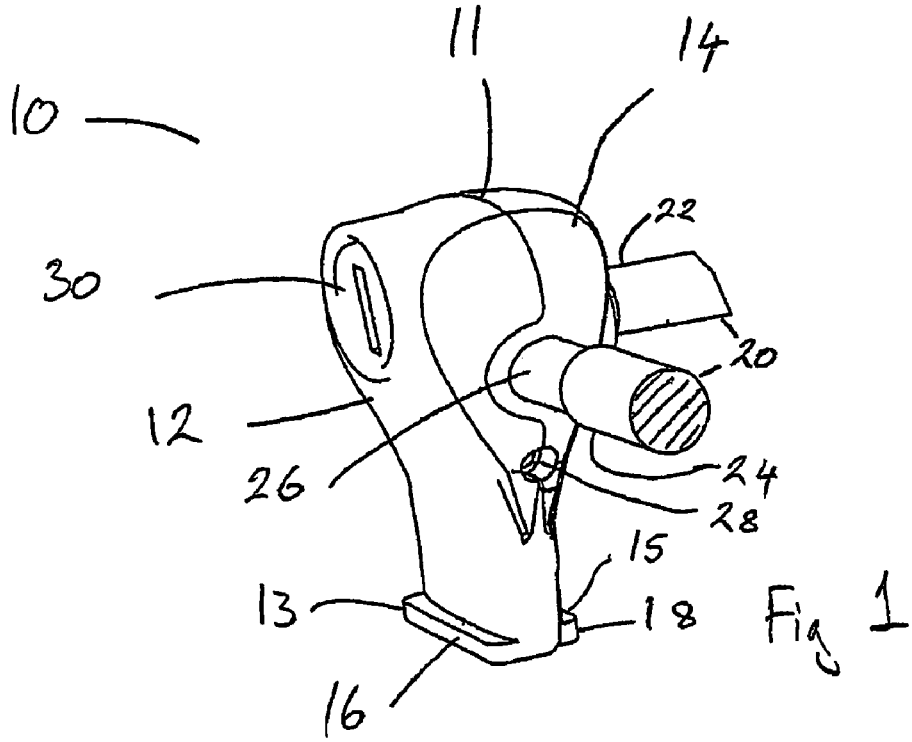
FIG. 1 is a perspective view of an embodiment of a surfboard lock according to the present invention with the engagement members in the extended position.

Referring to FIG. 1 a surfboard lock 10 is shown having a lock body 11 including a front cover 12 and a rear cover 14. The front and rear covers terminate in engagement members 13 and 15, shown in their extended position. These engagement members include outwardly projecting lugs 16 and 18. The lock further includes attachment means 20 in the form of a thick flexible cable. The cable has a first end 22 permanently affixed to the lock body 11 and a second end 24 terminating in a locking pin 26. The mid section of the cable is not shown. The cable may be of any length sufficient to allow it to extend around a sturdy object and the locking pin 26 to be inserted into lock body 11. Pin 28 forms a hinge which joins the front and rear covers. Lock barrel 30 may be rotated upon insertion of an appropriate key. This either retains or releases the locking pin 26 from the lock body 11.

Figure 2:
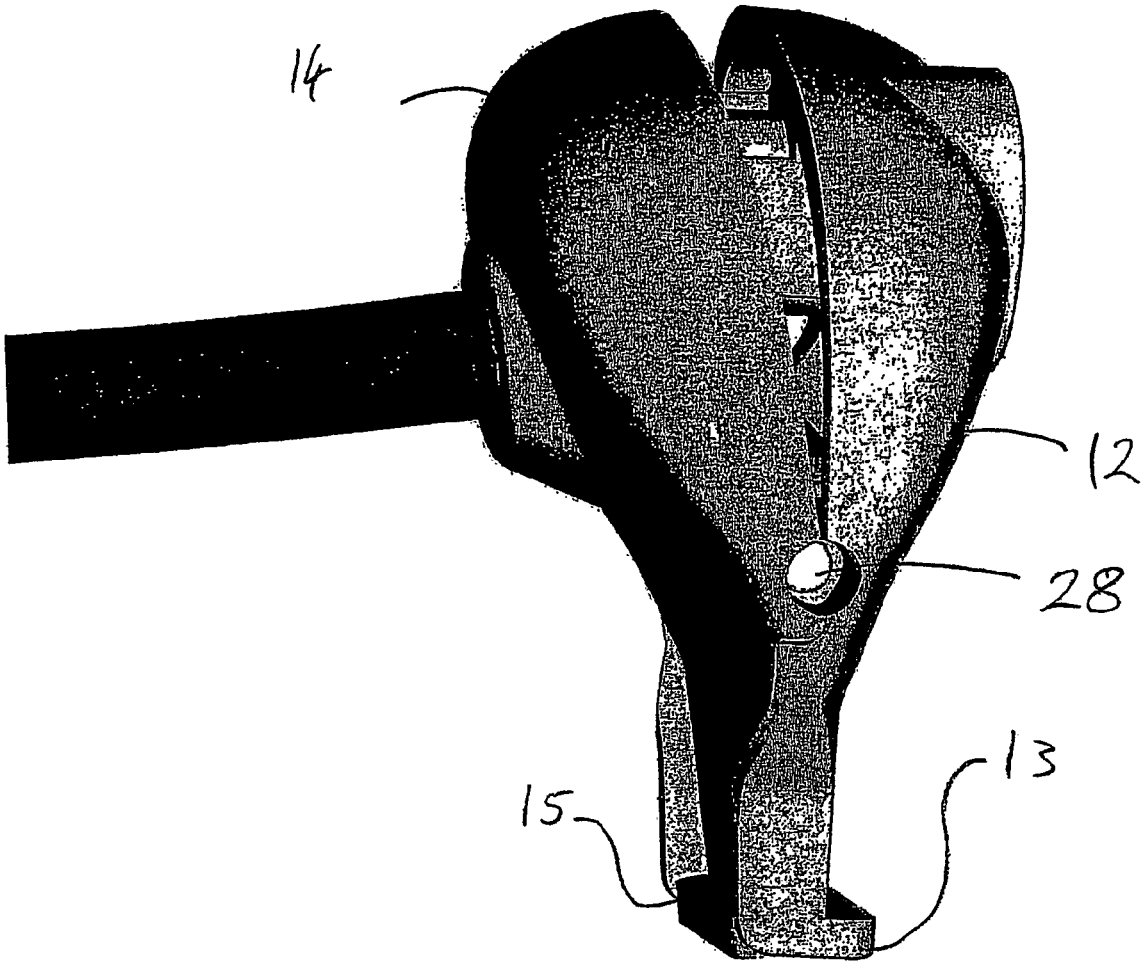
FIG. 2 is a perspective view of the surfboard lock of FIG. 1 shown with engagement members in the retracted position.

Referring to FIG. 2, the engagement members 13 and 15 are shown in the retracted position. This is achieved by rotation of the front cover 12 and rear cover 14 about the hinge formed by pin 28. When the engagement members 13 and 15 are in this position they may be introduced into a finbox opening of a surfboard. The engagement members 13 and 15 may then be returned to their extended position, again by rotation of the front and rear covers 12 and 14 about the hinge formed by pin 28.

Figure 4:
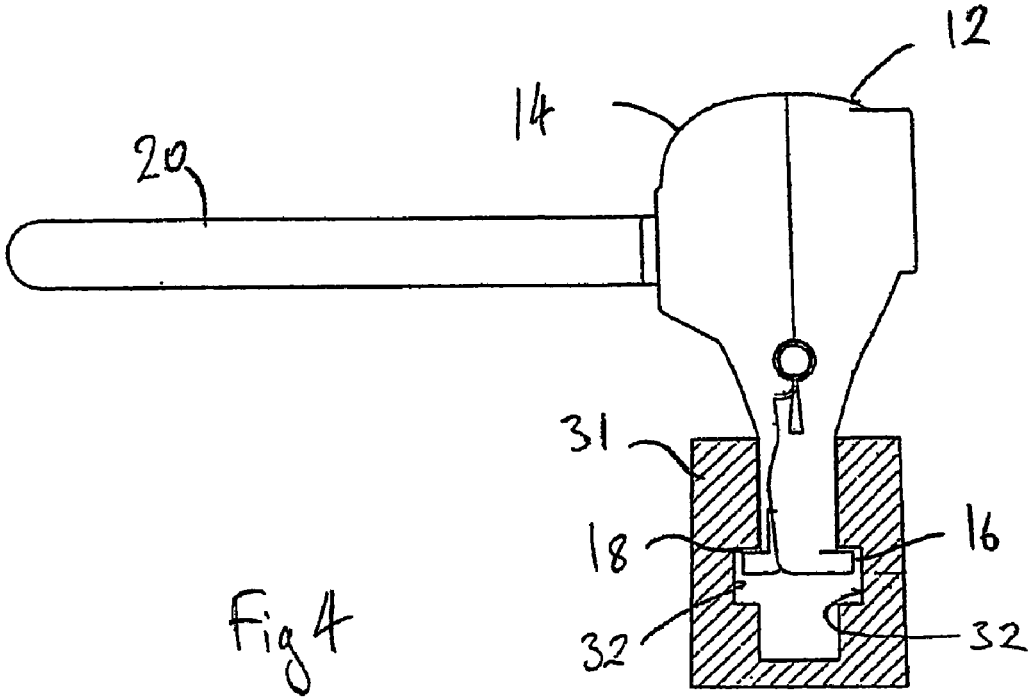
FIG. 4 is an elevation view of the surfboard lock of FIG. 1 engaged with a finbox. The finbox is shown in cross section.
Figure 3:
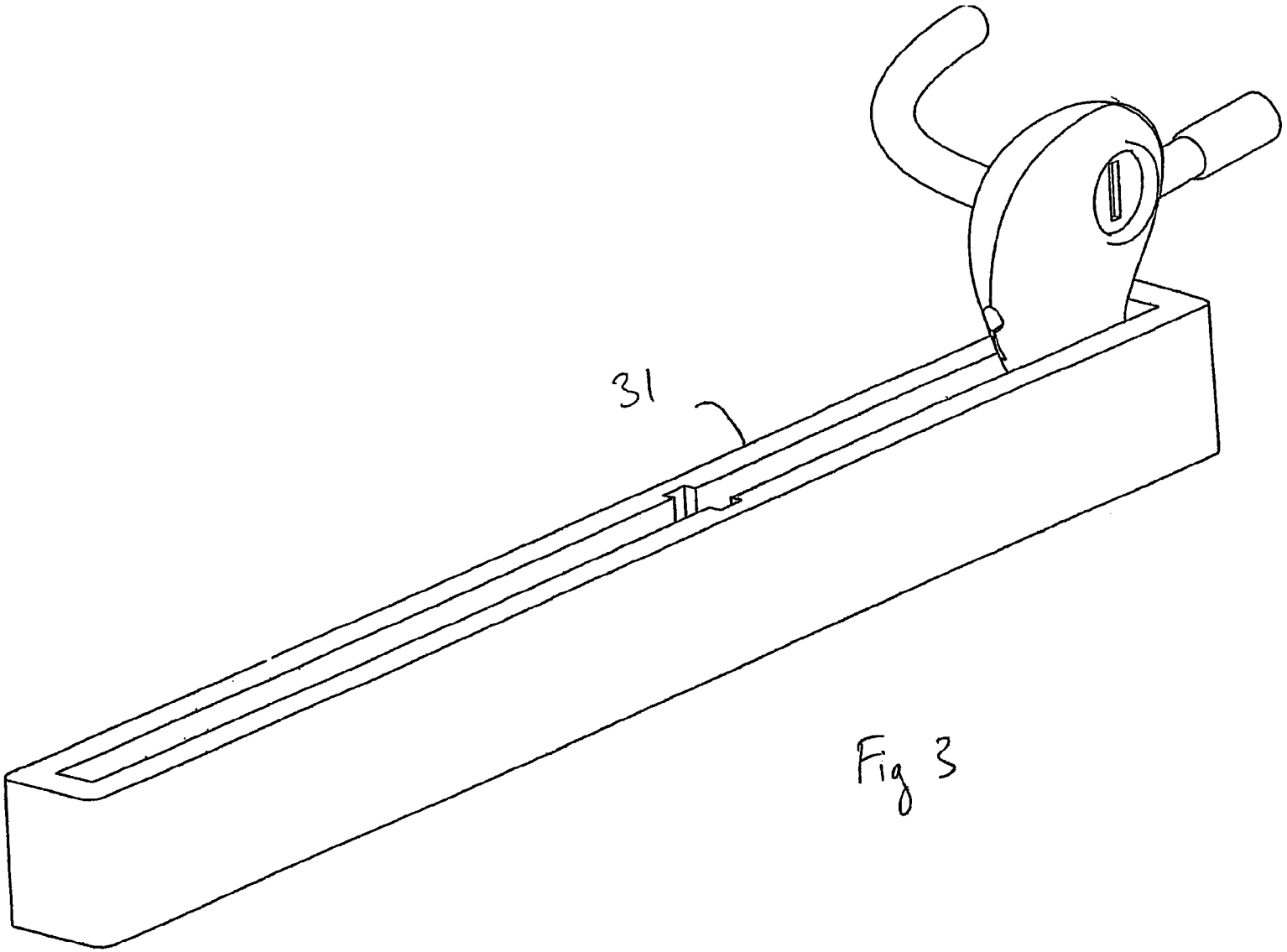
FIG. 3 is a perspective view of the surfboard lock of FIG. 1 engaged with a finbox.

Referring to FIGS. 3 and 4, the lock 10 is shown engaged with a finbox 31 for use with a surfboard. The outwardly extending lugs 16 and 18 engage with internal longitudinal recesses 32 in the walls of the finbox 31. In use, the finbox 31 is securely affixed to the surfboard. The finbox 31 is embedded into the underside of the surfboard and affixed with adhesive. Th finbox may be partly enclosed by the exterior glossy surface layer of the surfboard. Indeed, forced removal of a finbox typically results in significant damage to the surfboard.

Figure 5:
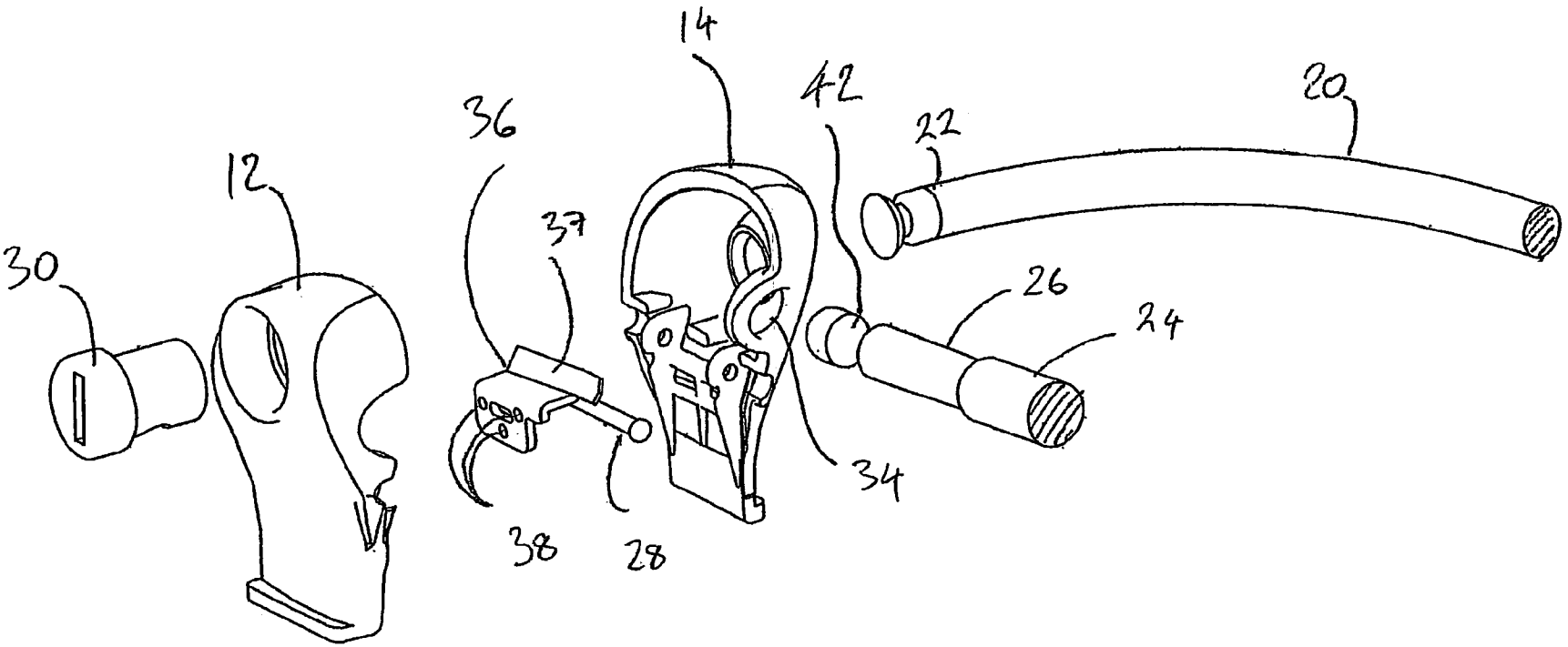
FIG. 5 is an exploded view of the surfboard lock of FIG. 1.
Figure 6:
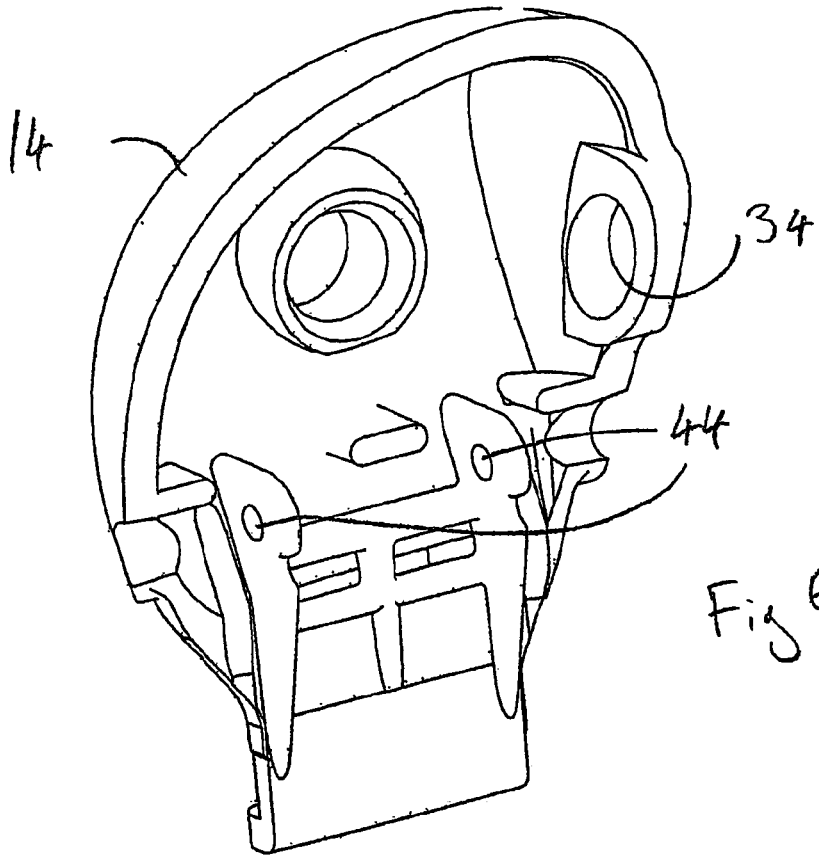
FIG. 6 is a perspective view of the rear cover of the surfboard lock of FIG. 1.
Figure 7:
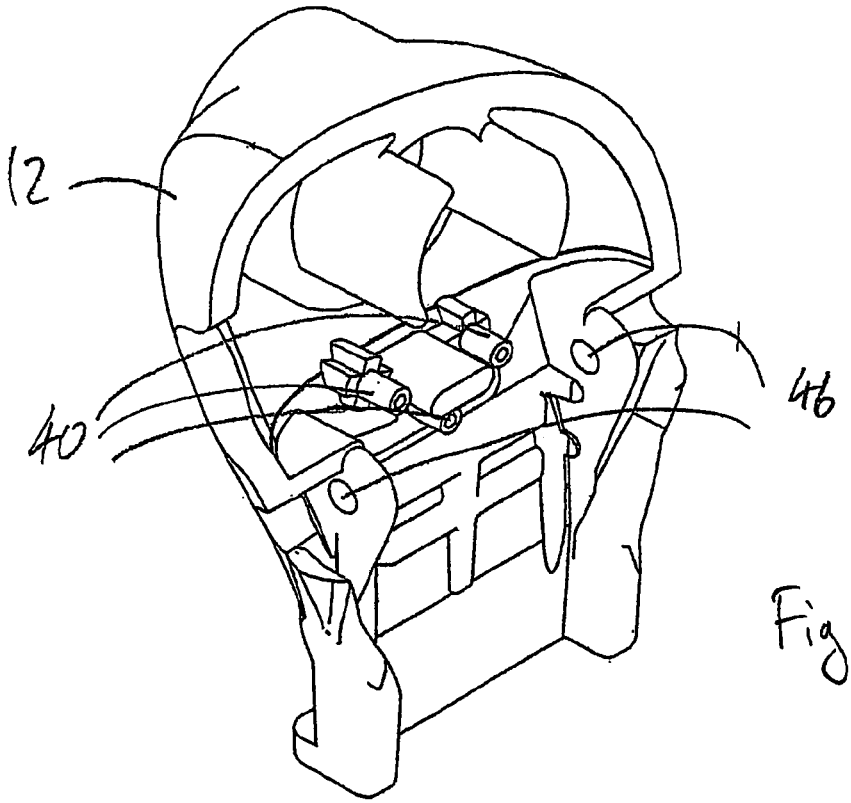
FIG. 7 is a perspective view of the front cover of the surfboard lock of FIG. 1.

Referring to FIGS. 5, 6 and 7, to lock the engagement members 13 and 15 in their extended position locking pin 26 is introduced into the lock body 11 through hole 34 in the rear cover 14. Locking pin 26 abuts flange 37 of locking piece 36 which is located onto front cover 12 by holes 38 fitting over lugs 40 and retained in place by inserting screws or rivets into lugs 40. The abutment of the locking pin 26 with flange 37 in combination with being passed through hole 34 prevents rotation of the front and rear covers 12 and 14 about the hinge formed by pin 28 and thus prevents the engagement members from being moved into their retracted position.

Referring to FIGS. 6 and 7, pin 28 (not shown) passes through eyelets 44 and 46. This holds front cover 12 and rear cover 14 together and provides the hinge about which front cover 12 and rear cover 14 rotate.

Lock barrel 30 can be rotated upon insertion of the appropriate key. This rotation causes the lock barrel 30 to engage a narrowed portion 42 of locking pin 26. Thus engaged, locking pin 26 is retained in engagement with lock body 11 and can only be removed with extreme force sufficient to destroy the lock.

Prior to inserting locking pin 26 into lock body 11 the cable 20 is passed about a sturdy object. Thus, the retention of locking pin 26 in lock body 11 not only locks the engagement members in their extended position, but it also serves to attach the lock 10 to the sturdy object by way of cable 20 and thus resist unauthorised removal of the surfboard.

Typically, there will be enough room to affix the lock to the finbox even if there is a fin retained in the finbox. This will depend upon the dimensions of the particular finbox and fin combination being used.

Instead of a lock barrel 30, a combination lock may be used to retain locking pin 26.

The components of the lock are preferably made from stainless steel to provide a combination of strength and resistance to corrosion. The lock should be dimensioned according to the materials used to provide for suitable strength to resist unauthorised removal of the lock.

Finally, it is to be appreciated that various alterations or additions may be made to the parts previously described without departing from the spirit or ambit of the present invention.

The claims defining the invention are as follows:

1. A surfboard lock of unitary construction comprising:

a lock body comprising two engagement members, wherein the engagement members are movable from a retracted position to an extended position and lockable in the extended position, wherein in the retracted position the engagement members may be at least partially introduced into a finbox opening of a surfboard, wherein in the extended position the engagement members may engage with the internal walls of the finbox opening to resist removal of the lock therefrom; and an attachment member for attaching the lock to a sturdy object, the attachment member comprising a cable with one end being permanently affixed to the lock body and another end of the cable being permanently affixed to a locking pin which is engageable with the lock body when the attachment member is passed around the sturdy object to attach the lock to the sturdy object.

2. The surfboard lock according to claim 1 wherein the engagement members are movable between the extended and retracted positions by rotating about a hinge axis.

3. The surfboard lock according to claim 2 wherein the two engagement members are formed integrally with two cover members.

4. The surfboard lock according to claim 3 wherein the cover members are pivoted to form the hinge axis.

5. The surfboard lock according to claim 1 wherein the engagement members are lockable in the extended position by inserting the locking pin into the lock.

6. The surfboard lock according to claim 2 wherein the engagement members are lockable in their extended position by inserting the locking pin through a hole in a cover member, wherein the locking pin further abuts a locking piece affixed to the other cover member to resist relative movement between the cover members.

7. The surfboard lock according to claim 1 wherein the engagement members include oppositely and outwardly directed lugs.

8. The surfboard lock according to claim 1 wherein the attachment member is flexible.

* * * * *